United States Patent [19]

Williams

[11] 4,277,961

[45] Jul. 14, 1981

[54] SECURITY LOCK NUT ASSEMBLY FOR PADLOCKS

[76] Inventor: Theodore L. Williams, 1200 E. 101 St., Kansas City, Mo. 64131

[21] Appl. No.: 73,884

[22] Filed: Sep. 10, 1979

[51] Int. Cl.[3] ..... E05B 67/38

[52] U.S. Cl. ..... 70/54; 70/230

[58] Field of Search ..... 70/6, 7, 8, 54, 55, 70/56, 229, 230, 232; 292/340

[56] References Cited

U.S. PATENT DOCUMENTS

| | | | |
|---|---|---|---|
| 2,825,218 | 3/1958 | O'Brien | 70/7 |
| 2,955,453 | 10/1960 | Mitchell | 70/232 |
| 3,561,236 | 2/1971 | Loughlin | 70/232 |
| 3,834,195 | 9/1974 | Winkhaus | 70/54 |
| 4,003,228 | 1/1977 | Lievens | 70/232 |

*Primary Examiner*—Robert L. Wolfe

*Attorney, Agent, or Firm*—Schmidt, Johnson, Hovey & Williams

[57] ABSTRACT

A security lock nut assembly for padlocks is provided which effectively prevents prying off or cutting of the padlock during use thereof. The assembly preferably includes a T-shaped padlock-engaging keeper nut having a bored main shaft, and a complemental screw secured to and extending from a support surface adjacent the padlock. In use, the keeper is positioned for engagement with a closed padlock, with the keeper shaft extending throuh the region defined by the padlock shackle and base and connected to the bolt. In this manner the padlock is held in place adjacent the support surface to restrict access to the padlock and thus prevent prying or cutting thereof. The transverse, padlock-engaging section of the keeper is sized to pass between the shackle and base only when the padlock is opened, and the keeper shaft is configured relative to the shackle to preclude rotation of the keeper when the padlock is locked in place. Simultaneous rotation of the padlock and keeper is prevented by means of projection structure located adjacent the padlock. The keeper can thus be unscrewed only when the padlock is opened and removed from the keeper.

4 Claims, 14 Drawing Figures

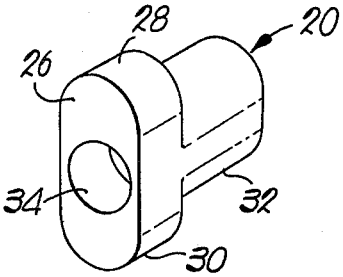
Fig. 1.
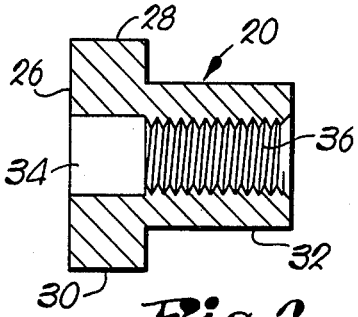
Fig. 2.
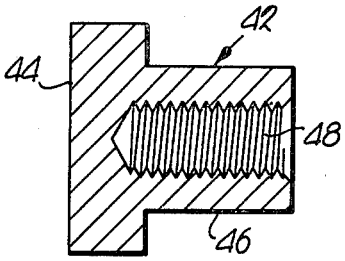
Fig. 3.
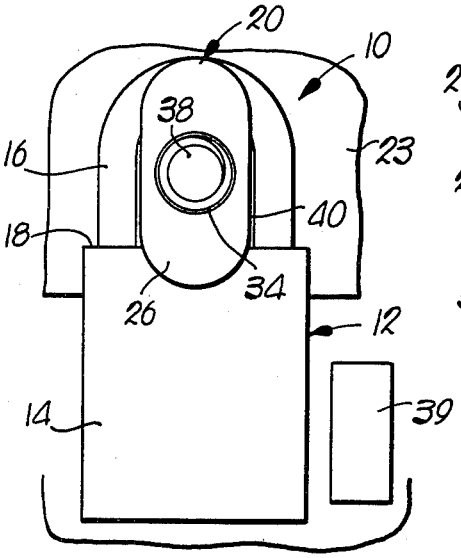
Fig. 4.
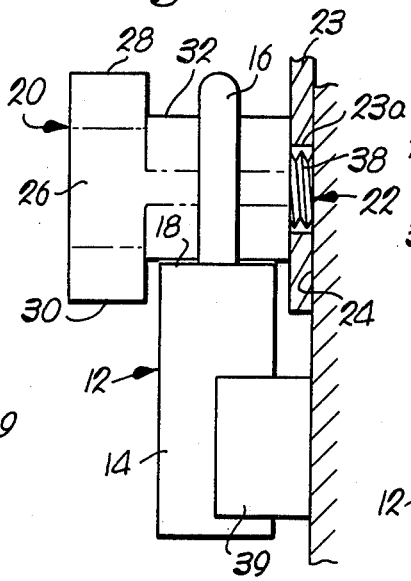
Fig. 5.
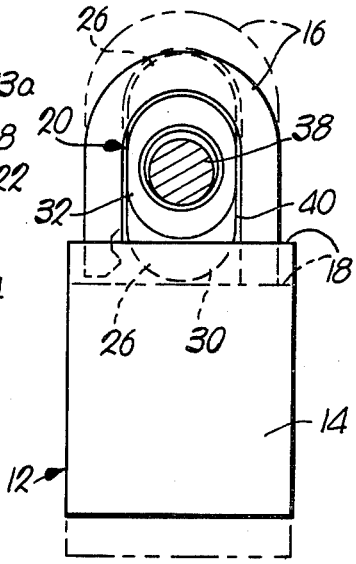
Fig. 6.
Fig. 7.
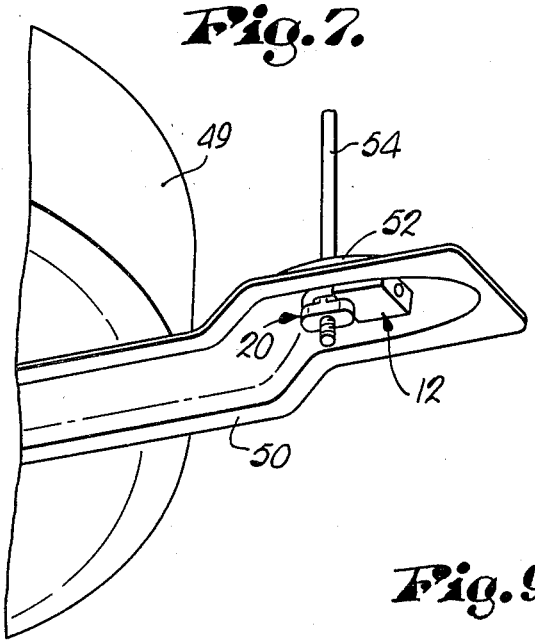
Fig. 8.
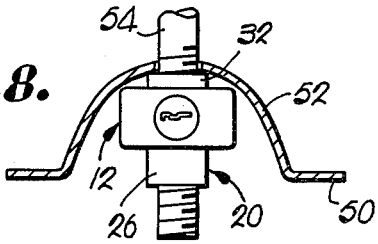
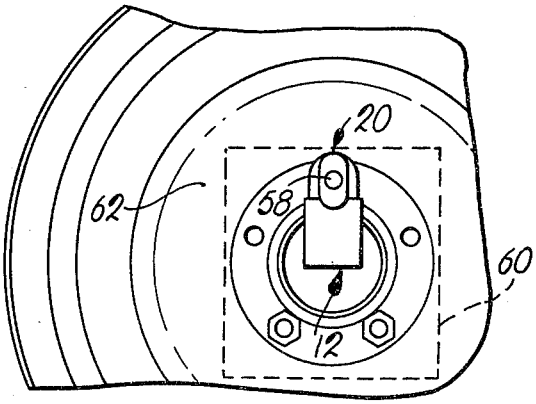
Fig. 9.

SECURITY LOCK NUT ASSEMBLY FOR PADLOCKS

BACKGROUND OF THE INVENTION

1. Field of the Invention

The present invention is concerned with a security lock nut assembly adapted for use with conventional shackle-type padlocks for enhancing the security function thereof by restricting access to the padlock and thus virtually precluding the possibility of prying or cutting of the padlock. More particularly, it is concerned with such an assembly which, in preferred forms, includes a T-shaped, bored keeper nut along with a complemental screw for threaded connection of the keeper in a manner to hold the padlock in place against a support surface.

2. Description of the Prior Art

A persistent problem encountered by the owners of vending machines and the like is that these machines are periodically broken into and the contents thereof (money and goods) stolen. In the case of wall mounted vending machines for example, it has heretofore been the practice to simply padlock the machines in an attempt to prevent theft. However, conventional padlocks are prone to forced opening either by prying as with a crowbar or through the use of lock cutters.

Similarly, certain types of vehicles such as pickup trucks or jeeps have spare tires exteriorily mounted thereon, such as on a tailgate. In such cases the tires are subject to being stolen, and owners of such vehicles therefore need a strong, secure locking assembly for their tires. Here again, although a simple shackle-type padlock can be used, such does not afford a full measure of protection against theft.

SUMMARY OF THE INVENTION

The present invention overcomes the problems noted above and, when used with a conventional shackle-type padlock, secures the latter against forced opening by prying and/or cutting. Broadly speaking, the assembly of the invention includes a padlock-engaging keeper, and means for releasably maintaining the keeper in operative engagement with the padlock so as to maintain the latter proximal to an adjacent support surface. The keeper-maintaining means further includes structure permitting release of the keeper only after opening of the shackle, so as to further enhance the integrity of the overall arrangement.

Preferably, the keeper is of T-shaped configuration and includes an elongated, padlock-engaging element and an elongated, bored main shaft configured to pass between the shackle and base of the padlock, when the latter is closed. In this form, the maintaining means comprises in part a screw extending from the support surface and received within the shaft bore.

In the use of the preferred invention, the keeper structure is first threaded onto the screw therefor, whereupon the padlock shackle is passed around the shaft, and the padlock is closed. In this orientation passage of the transverse, padlock-engaging element through the area defined between the shackle and base of the padlock is prevented. Moreover, the extending shaft is configured such that axial rotation thereof is precluded while the padlock remains closed. When it is desired to open the assembly, the padlock is first opened and removed from the T-shaped keeper. This is permitted by virtue of the fact that the transverse padlock-engaging element is sized so as to fit between the shackle and base, when the padlock is opened. After the padlock has been removed, the keeper can simply be unscrewed and detached from the screw.

BRIEF DESCRIPTION OF THE DRAWINGS

FIG. 1 is a perspective view of the preferred T-shaped lock nut keeper of the invention;

FIG. 2 is a longitudinal vertical section of the keeper illustrated in FIG. 1;

FIG. 3 is a longitudinal vertical section of another embodiment of the keeper;

FIG. 4 is an elevational view of the security lock nut assembly of the invention, shown in use with a conventional shackle-type padlock;

FIG. 5 is a side elevational view of the arrangement illustrated in FIG. 4;

FIG. 6 is a rear elevational view of the structure shown in FIG. 4, with the open position of the padlock being illustrated in phantom;

FIG. 7 is a fragmentary perspective view of a pickup truck spare tire bracket, shown with the assembly of the invention and a padlock operatively mounted on the bracket;

FIG. 8 is a vertical cross sectional view further illustrating the construction of the padlock and securement assembly depicted in FIG. 7;

FIG. 9 is a fragmentary elevational view of an exteriorily mounted tire with the padlock and securement assembly of the invention mounted on the same;

DESCRIPTION OF THE PREFERRED EMBODIMENTS

Figure 11:
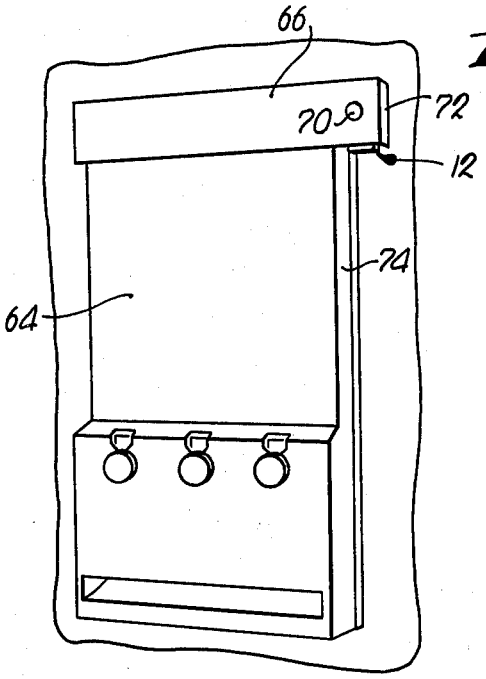
FIG. 11 is a perspective view of a wall-mounted vending machine.

Turning now to the drawings, FIGS. 4–6 depict a security lock nut assembly 10 in accordance with the invention which is adapted for use with a conventional, shackle-type padlock 12. The latter includes a base 14 and a U-shaped, case hardened shackle 16 operatively secured to and extending upwardly from the upper surface 18 of base 14. As is usual with padlocks of this type, one leg of the shackle 16 is permanently secured to base 14 and is pivotal relative thereto, whereas the remaining leg is releasably secured to the base, thus permitting the padlock to be selectively opened and closed.

Assembly 10 includes a padlock keeper 20 along with means broadly referred to by the numeral 22 for releasably maintaining keeper 20 closely adjacent padlock 12 and proximal to a support surface 24, with the padlock 12 being disposed between the surface 24 and keeper 20. As will be more fully explained hereinafter, the keeper-maintaining means 22 further include structure for permitting release of the keeper 20 only after opening of the shackle 16 relative to the base 14. In the FIGS. 4–6 embodiment, a conventional, shiftable hasp plate 23 (apertured at 23*a*) is located between padlock 12 and surface 24.

In more detail, the keeper 20 (see FIGS. 1 and 2) is generally T-shaped and includes an elongated, plate-like, padlock engaging element 26 having a pair of rounded ends 28, 30. The keeper also has an elongated shaft 32 which is oblong in cross sectional configuration. A bore 34 passes through the shaft 32 and element 26, and is threaded as at 36 along the length of the shaft 32. Again referring to FIGS. 4–6, it will be seen that the keeper-maintaining means 22 includes, in addition to the threaded portion of bore 34, an elongated, complementally threaded screw 38 which is operatively connected to and extends outwardly from the surface 24, and is received within the threaded portion of bore 34. In the locking position of assembly 10 illustrated in FIGS. 4–6, the shaft 32 of keeper 20 passes through the area cooperatively defined by and between the upper surface 18 of base 14 and the shackle 16. It will be noted in this regard that the shaft 32 loosely passes through the area 40, but, when the shackle is closed, the shaft (and hence keeper 20) cannot be unthreaded from the screw 38. In addition, the padlock 12 and keeper 20 cannot be rotated in unison so as to unscrew the keeper by virtue of the presence of blocking projection 39 disposed adjacent base 14. Thus, the interference fit of shaft 32 within area 40, as well as the presence of projection 39, cooperatively serve to prevent release of keeper 20 until padlock 12 is opened and removed from the keeper 20.

It will also be observed that the element 26 is of substantially greater cross sectional dimensions than the area 40, thus preventing passage of the padlock 12 off of the keeper 20, when the padlock is closed. This situation is different, however, when padlock 12 is open. As best seen in the phantom illustration of FIG. 6, when the padlock 12 is opened the base 14 is shifted downwardly on one leg of the shackle 16 until the upper surface 18 of the base is sufficiently spaced from the uppermost point of the shackle 16 to permit passage of the entirety of element 26 therethrough. In this orientation the area presented and cooperatively defined between the shackle 16 and surface 18 is larger than the area 40, and is sufficient to clear the element 26 and thus permit the complete removal of the padlock 12 from the keeper 20.

In the use of assembly 10 in conjunction with a conventional padlock 12, the following procedure is followed. First, hasp plate 23 is manipulated such that aperture 23*a* thereof slips over and receives the outwardly extending screw 38. At this point keeper 20 is secured to the bolt 38, simply by threading the keeper onto the screw. At this point padlock 12 is opened, and shackle 16 thereof is passed over the shaft 32, and the lock is then closed. In this orientation, element 20 is proximal to or engages the padlock 12 (and particularly base 14 thereof), and moreover axial rotation of the keeper 20 in either direction relative to the padlock 12 is precluded by virtue of the interference presented by the cross sectionally oblong configuration of shaft 32, and the shackle 16. Simultaneous rotation of padlock 12 and keeper 20 is likewise prevented because of the presence of projection 39.

If it is desired to unlock the assembly 10 and padlock 12, it is only necessary to first unlock the padlock 12 and pass the same outwardly away from surface 24 and past the element 26. At this point the keeper can be conventionally unscrewed from the screw 38, and hasp plate 23 opened.

It will further be observed that when the padlock and assembly 10 are operatively positioned, access to the padlock for purposes of forced opening is severely restricted. Specifically, it will be seen that the presence of keeper 20 makes it virtually impossible to insert a pry bar between the shackle and base of the padlock 12, or for that matter to effectively insert a pry bar behind the base 14. Moreover, use of lock cutters is prevented inasmuch as insufficient clearance for the cutters is presented in the area of the shackle 16. This is due not only to the inability to significantly move padlock 12, but also to the fact that shaft 32 fills a substantial portion of the area 40.

The present invention is susceptible to many variations, both in the particular structure thereof, and in end uses. For example, FIG. 3 illustrates a modified keeper 42 which is again of generally T-shaped configuration. The keeper 42 includes an elongated, padlock-engaging element 44 along with an elongated, axially bored, oblong in cross section shaft 46. The axial bore thereof is threaded as at 48. The difference between the keeper 42 and keeper 20 previously described is that in the present case the shaft bore does not extend completely through the keeper, but terminates as illustrated in FIG. 3 within the keeper.

FIGS. 7–8 illustrate another use of the invention for locking a pickup or other vehicle tire to a frame member. Specifically, as is usual in constructions of this type, a tire 49 is mounted by means of an elongated bracket 50 which is provided with a dished, apertured end locking region 52. An elongated, threaded mounting bolt 54 is passed through the apertured dished region 52, and is secured to an appropriate frame member (not shown). The present invention is eminently suited for use in locking the bracket 50 in place over the tire 49, so as to prevent theft of the latter. As best seen in FIG. 8, the padlock 12 and keeper 20 are mounted on the outermost threaded end of the bolt 54 in the manner described in connection with the embodiments of FIGS. 4–6. In this orientation the padlock 12 is maintained between the element 26 and the inner surface of the dished region 52. Moreover, rotation of the keeper 20 and padlock 12 in unison is precluded by virtue of the dished sidewall of the region 52, as will be apparent from a study of FIG. 8. It will also be noted that the bolt 54 passes completely through the element 20 in this embodiment, so as to permit whatever degree of tightening of the element that is necessary for rigidly maintaining bracket 50 in place.

Figure 10:
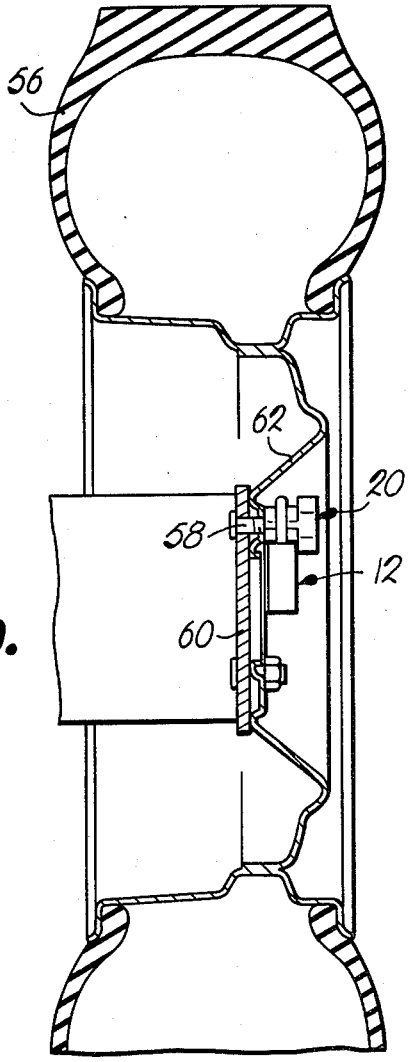
FIG. 10 is a vertical sectional view of the wheel and mounting bracket illustrated in FIG. 9, and showing the padlock and securement assembly of the invention.

FIGS. 9–10 illustrate yet another use of the present invention, in securing a tire 56 in place on a pickup truck tailgate or the like. Here again, the structure of FIGS. 4–6 is employed, i.e., the padlock 12 and keeper 20. In this case however, an elongated, threaded bolt 58 extends outwardly from the central mounting bracket 60 for the tire 56 (see FIG. 10), and the keeper 20 is threaded onto the bolt 58 as shown. In this instance rotation of padlock 12 and keeper 20 in unison is prevented by virtue of the circular, sloped sidewall 62 of the tire wheel.

Figure 12:
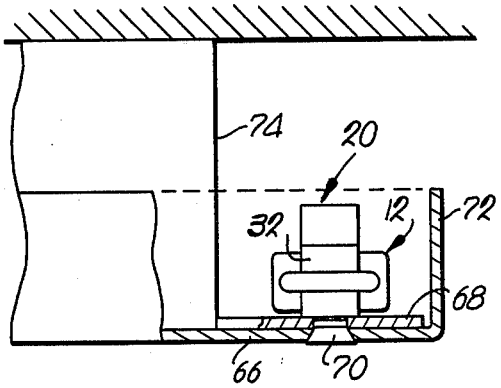
FIG. 12 is a fragmentary top plan view with parts broken away for clarity of the vending machine illustrated in FIG. 11, and depicting the padlock and securement assembly of the invention operatively mounted on the machine.

FIG. 11–12 illustrate the use of the present invention in connection with a wall mounted vending machine 64 which includes an elongated, uppermost locking bar 66. As seen in FIG. 12, the assembly of the present invention including padlock 12 and keeper 20 is employed for locking the bar 66 to an apertured internal plate 68.

Specifically, a mounting screw 70 passes through bar 66 and plate 68, and the shaft 32 of keeper 20 is screwed onto the screw 70. As above, the padlock 12 is operatively positioned on the shaft 32 of the keeper 20. In this instance rotation of the lock and keeper is precluded by virtue of the rearwardly extending lip 72 of bar 66, and the sidewall 74 of vending machine 64.

Figure 13:
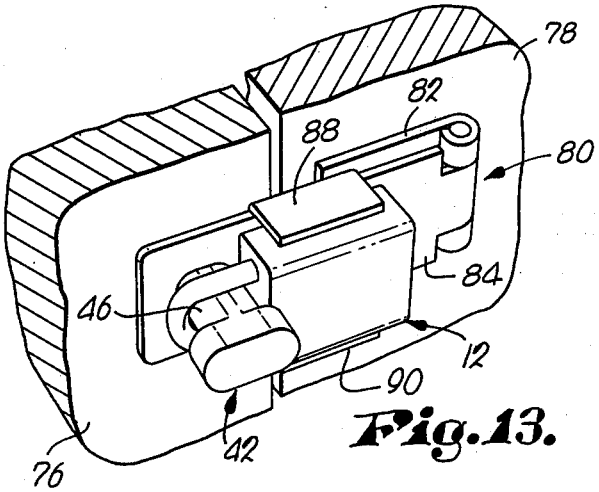
FIG. 13 is a perspective view of a hasp, padlock, and securement assembly of the invention, shown operatively disposed in locking a door.
Figure 14:
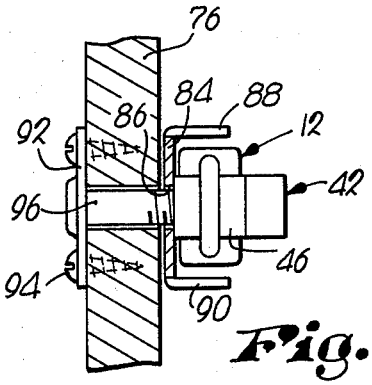
FIG. 14 is a vertical sectional view of the structure shown in FIG. 13, which further depicts the construction of the securement assembly.

A final illustrative use of the invention is depicted in FIGS. 13–14. Specifically, a door 76 is secured to a jamb 78 using the present invention along with a modified hasp 80. The hasp 80 includes a first plate 82 fixedly secured to jamb 78, along with a second plate 84 which is hingedly secured to plate 82 and extends across the juncture between the door 76 and jamb 78. Plate 84 is apertured as at 86, and is provided with a pair of spaced, outwardly extending padlock-straddling walls 88, 90. A screw-supporting plate 92 is fixedly mounted to the inside of door 76 by means of wood screws 94, and supports an elongated, threaded screw 96 which extends through the door 76 and aperture 86. The keeper 42 of the present invention is screwed onto the outermost end of screw 96, and padlock 12 is operatively secured to the shaft 46 of the keeper. The embodiment illustrated in FIGS. 13–14 functions in the manner described above, it being noted that the rotation of the padlock 12 and keeper 42 is prevented by virtue of the projecting walls 88, 90.

Having thus described the invention, what is claimed as new and desired to be secured by Letters Patent is:

1. An assembly for securing a padlock in place adjacent a surface for preventing forced opening of the padlock, said padlock having a base and a shackle operably coupled to the base, said assembly comprising:

a padlock keeper including an elongated, padlock-engaging element, and an elongated shaft connected to said element and configured to pass through a first area towards said surface, said first area being cooperatively defined between said shackle and base when said padlock is closed; and means for releasably maintaining said keeper proximal to said surface with said keeper being adjacent said padlock and with the padlock being disposed between said surface and said keeper, said keeper-maintaining means comprising a threaded bore in said shaft, and complemental screw means operatively secured to and extending from said surface and received within said bore, said keeper-maintaining means including structure for permitting release of the keeper only after opening of said shackle.

2. The assembly as set forth in claim 1 wherein said element is configured to pass through a second area cooperatively defined between said shackle and said base, when said padlock is opened.

3. The assembly as set forth in claim 1 wherein said structure includes first means for preventing rotation of said shaft relative to said padlock, and second means for preventing rotation of said shaft and padlock in unison.

4. The assembly as set forth in claim 3 wherein said first rotation-preventing means comprises interference fit structure between said shaft and shackle, and said second rotation-preventing means comprises projection structure adjacent said padlock for precluding rotation of the padlock about the axis of said shaft.

* * * * *